US009206697B2

(12) United States Patent
Tibbott et al.

(10) Patent No.: US 9,206,697 B2
(45) Date of Patent: Dec. 8, 2015

(54) AEROFOIL COOLING

(71) Applicant: ROLLS-ROYCE PLC, London (GB)

(72) Inventors: Ian Tibbott, Lichfield (GB); Dougal Richard Jackson, Stanton by Bridge (GB)

(73) Assignee: ROLLS-ROYCE PLC, London (GB)

( * ) Notice: Subject to any disclaimer, the term of this patent is extended or adjusted under 35 U.S.C. 154(b) by 669 days.

(21) Appl. No.: 13/734,491

(22) Filed: Jan. 4, 2013

(65) Prior Publication Data

US 2014/0140860 A1 May 22, 2014

(30) Foreign Application Priority Data

Jan. 20, 2012 (GB) ..... 1200930.4

(51) Int. Cl.
*F01D 5/18* (2006.01)

(52) U.S. Cl.
CPC ..... *F01D 5/187* (2013.01); *F01D 5/186* (2013.01); *F01D 5/188* (2013.01); *F05D 2250/15* (2013.01); *F05D 2250/25* (2013.01)

(58) Field of Classification Search
CPC ..... F01D 5/186; F01D 5/187; F01D 5/188; F05D 2250/15; F05D 2250/25
See application file for complete search history.

(56) References Cited

U.S. PATENT DOCUMENTS

| | | | | |
|---|---|---|---|---|
| 4,080,095 | A | 3/1978 | Stahl | |
| 4,991,390 | A | 2/1991 | Shah | |
| 5,993,156 | A * | 11/1999 | Bailly et al. | 416/96 A |
| 6,254,347 | B1 * | 7/2001 | Shaw et al. | 416/97 R |
| 7,399,160 | B2 * | 7/2008 | Harvey et al. | 416/97 R |
| 7,824,156 | B2 * | 11/2010 | Dellmann et al. | 416/96 R |
| 7,914,257 | B1 | 3/2011 | Liang | |
| 8,052,378 | B2 * | 11/2011 | Draper | 415/115 |

FOREIGN PATENT DOCUMENTS

| | | |
|---|---|---|
| GB | 651787 | 4/1951 |
| GB | 2 238 582 A | 6/1991 |

OTHER PUBLICATIONS

May 14, 2012 Search Report issued in British Patent Application No. 1200930.4.

* cited by examiner

*Primary Examiner* — Troy Chambers
*Assistant Examiner* — Joshua Semick
(74) *Attorney, Agent, or Firm* — Oliff PLC

(57) ABSTRACT

An aerofoil component of a gas turbine engine is provided. The component has a longitudinally extending aerofoil portion which spans, in use, a working gas annulus of the engine. The aerofoil portion contains an internal chamber for a flow of coolant. The chamber includes a helical passage which spirals in a plurality of turns around an axis that extends in the length direction of the aerofoil portion.

12 Claims, 13 Drawing Sheets

(a)

(b)

(a)

(b)

AEROFOIL COOLING

FIELD OF THE INVENTION

The present invention relates to the cooling of an aerofoil component of a gas turbine engine.

BACKGROUND OF THE INVENTION

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The performance of gas turbine engines, whether measured in terms of efficiency or specific output, is improved by increasing the turbine gas temperature. It is therefore desirable to operate the turbines at the highest possible temperatures. For any engine cycle compression ratio or bypass ratio, increasing the turbine entry gas temperature produces more specific thrust (e.g. engine thrust per unit of air mass flow). However as turbine entry temperatures increase, the life of an un-cooled turbine falls, necessitating the development of better materials and the introduction of internal air cooling.

In modern engines, the high-pressure turbine gas temperatures are hotter than the melting point of the material of the blades and vanes, necessitating internal air cooling of these airfoil components. During its passage through the engine, the mean temperature of the gas stream decreases as power is extracted. Therefore, the need to cool the static and rotary parts of the engine structure decreases as the gas moves from the high-pressure stage(s), through the intermediate-pressure and low-pressure stages, and towards the exit nozzle.

FIG. 2 shows an isometric view of a typical single stage cooled turbine. Cooling air flows are indicated by arrows.

Internal convection and external films are the prime methods of cooling the gas path components—airfoils, platforms, shrouds and shroud segments etc. High-pressure turbine nozzle guide vanes 31 (NGVs) consume the greatest amount of cooling air on high temperature engines. High-pressure blades 32 typically use about half of the NGV flow. The intermediate-pressure and low-pressure stages downstream of the HP turbine use progressively less cooling air.

The high-pressure turbine airfoils are cooled by using high pressure air from the compressor that has by-passed the combustor and is therefore relatively cool compared to the gas temperature. Typical cooling air temperatures are between 800 and 1000 K, while gas temperatures can be in excess of 2100 K.

The cooling air from the compressor that is used to cool the hot turbine components is not used fully to extract work from the turbine. Therefore, as extracting coolant flow has an adverse effect on the engine operating efficiency, it is important to use the cooling air effectively.

Ever increasing gas temperature levels combined with a drive towards flatter combustion radial profiles, in the interests of reduced combustor emissions, have resulted in an increase in local gas temperature experienced by the extremities of the blades and vanes, and the working gas annulus endwalls.

A turbine blade or vane has a longitudinally extending aerofoil portion with facing suction side and pressure side walls. The aerofoil portion extends across the working gas annulus, with the longitudinal direction of the aerofoil portion being along a radial direction of the engine. FIG. 3 shows a longitudinal cross-section through a high-pressure turbine blade. A multi-pass cooling passage 33 is fed cooling air by a feed passage 34 at the root of the blade. Cooling air eventually leaves the multi-pass cooling passage through exit holes at the tip 35 and the trailing edge 36 of the blade. Some of the cooling air, however, can leave the multi-pass cooling passage through effusion holes (not shown) formed in the suction side and pressure side walls. The block arrows in FIG. 3 show the general direction of cooling air flow.

The (triple) multi-pass cooling passage 33 is formed by two divider walls 37 which interconnect the facing suction side and pressure side walls of the aerofoil portion to form three longitudinally extending, side-by-side passage portions 38. Other aerofoil portions can have more or fewer divider walls and passage portions. The passage portions are connected in series fluid flow relationship by respective bends 39 which are formed by the joined ends of neighbouring passage portions. The cooling air thus enters the multi-pass cooling passage at the passage portion at the leading edge of the aerofoil portion and flows through each passage portion in turn to eventually leave from the passage portion at the trailing edge. Trip strip 40 and pedestal 41 heat transfer augmentation devices in the passage portions enhance heat transfer between the cooling air and the metal.

The internal convection is achieved by two mechanisms, firstly through augmented channel flow, or impingement cooling inside the cooling passage, and secondly by the internal convection inside the film cooling holes.

The complicated internal structure of the aerofoil portion is generally formed by an investment casting procedure. Thus the mould for the aerofoil portion has a core structure which is a "negative" of the ultimate internal structure of the aerofoil portion. In particular, the mould has passage features corresponding to the longitudinally extending passage portions 38.

In order to maintain acceptable component lives in particularly the high pressure turbine rotor blade, more effective cooling schemes have been adopted, such as impingement leading edge cooling arrangements and cyclonic or forced vortex cooling, specifically in the vicinity of the aerofoil leading edge, where the external heat load is at its greatest.

US2006/0280607 proposes an aerofoil arrangement in which a first cooling passage has a tangential inlet flow from a neighbouring cooling passage. This develops a vortex in the first passage due to the momentum and direction of the flow. The vortex can be arranged to rotate in either a clockwise or anticlockwise direction by changing the location of the tangential feed channel. The strength of the vortex is a function of the flow rate, which is dependent on the pressure ratio between the passages and the flow area, and also the physical geometry (angle and location) of the tangential feed passage. However, the strength of the vortex reduces as flow is extracted up the span of the aerofoil.

It is possible to manufacture both this arrangement using conventional ceramic cores produced by multi-pull core dies or with soluble core technology.

SUMMARY OF THE INVENTION

It would be desirable to further improve the effectiveness of aerofoil component cooling schemes.

Accordingly, in a first aspect, the present invention provides an aerofoil component of a gas turbine engine, the component having a longitudinally extending aerofoil portion which spans, in use, a working gas annulus of the engine, the aerofoil portion containing an internal chamber for a flow of coolant, the chamber including a helical passage which spirals in a plurality of turns around an axis that extends in the length direction of the aerofoil portion.

Advantageously, the coolant flow can be confined by the helical passage. This generates a centrifugal force, which can be maintained over the length of the passage, the force driving the coolant outwards and thereby encouraging the flow to remain attached to the walls defining the outer parts of the passage. The force also helps to reduce the thickness of the boundary layer, promoting high levels of heat transfer. In addition, the passage can increase the velocity in the flow, which can improve metal to coolant heat transfer. Also, the helical shape can increase the gas-washed surface area of the passage.

In a second aspect, the present invention provides a gas turbine engine having one or more aerofoil components according to the first aspect.

Optional features of the invention will now be set out. These are applicable singly or in any combination with any aspect of the invention.

Typically, the helical passage can spiral around the axis in at least four turns, significantly greater numbers of turns may be adopted, for example, at least eight, ten or twelve turns, depending on the component.

The chamber can include a core passage which extends along the axis, the helical passage being in fluid communication with the core passage such that coolant flows along the core passage and is then fed into the helical passage. The core passage can thus replenish coolant which may be lost from the helical passage e.g. via film cooling effusions holes. The fluid communication may be arranged such that coolant flows along the core passage and is fed into the helical passage over substantially the entire length of the helical passage. Preferably, the core passage tapers in the direction of coolant flow, such an arrangement can encourage the coolant to be progressively fed from the core passage into the helical passage. The taper can progress smoothly and/or in a series of steps. Preferably, the core passage is configured such that substantially none of the coolant flow exits the core passage other than by the helical passage.

Alternatively, the chamber may be configured such that the coolant flow enters the helical passage at one end thereof, but not at any positions along the side of the helical passage most proximal to said axis. Thus, for example, the chamber may have no core passage feeding coolant into the helical passage.

The component may further have a support pillar which extends along the axis and which supports walls which define the helical passage. Such an arrangement can be beneficial, for example, if there is no need to replenish the coolant flow in the helical passage from a core passage and/or if the defining walls are relatively thin or fragile. The support pillar can be hollow. In this way a flow of coolant can be carried by the support pillar, e.g. to transfer coolant from the root to the tip of a turbine blade to be used for blade tip cooling.

The thickness of the helical passage in the direction of said axis can be greater at the side of the helical passage most distal from the axis than at the side of the helical passage most proximal to the axis. Thus, in the axial direction, the helical passage can expand with distance from the axis.

The helical passage may be configured to extend, in use, over at least half of the span of the working gas annulus. Indeed, the helical passage may be configured to extend, in use, over substantially all of the span of the working gas annulus.

A plurality of effusion holes, e.g. for surface film cooling of the component, may extend from the helical passage to the outer surface of the component. Any coolant that does not leave the chamber via effusion holes, may exit, for example, at a component (e.g. blade) tip and/or at the aerofoil portion suction side.

The helical passage can include heat transfer augmentation features which cause the coolant flow to separate from and reattach to the walls thereof. For example, the features can be at outer wall at the side of the helical passage most distal from the axis, and can take the form of trip strips and/or steps. Such features generally promote secondary swirling flow and thereby increase turbulent mixing.

The chamber may include one or more further helical passages which each spiral in a plurality of turns around said axis. When the chamber has a plurality of helical passages, the rate of temperature increase with axial distance of the coolant carried by each passage as it flows along the passage can be reduced, allowing the coolant to have an improved cooling effect over greater axial distances.

The or each helical passage may have an outer wall at the side of the helical passage most distal from the axis, the wall or walls lying on a cylindrical or frustoconical surface which is substantially coaxial with said axis. In particular, a frustoconical surface which tapers with increasing axial distance from an inlet to the chamber, is consistent with a decrease in overall flow area for the chamber with increasing axial distance. In this way, flow velocities in the chamber can be maintained despite e.g. coolant loss to component surface film cooling. Typically, the wall or walls may cover at least 50%, or more preferably at least 80%, of the cylindrical or frustoconical surface, which can increase the gas-washed surface area of the helical passage.

The chamber may extend from a root of the component and may have an inlet for the flow of coolant at the root.

The chamber may be located at or adjacent a leading edge of the component.

The aerofoil portion may contain a plurality of the internal chambers.

The component can be a rotor blade or a nozzle guide vane.

Further optional features of the invention are set out below.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

The present invention relates to a component having an aerofoil portion which contains a helical passage for coolant flow, the passage spiralling around an axis that extends in the length direction of the aerofoil portion. The helical shape can increase the gas-washed surface area of the passage. Further, the cooling flow can be confined to flow in a spiral direction by the walls of the passage.

The complex shape of the helical passage limits the manufacturing processes that can be employed to produce the component. However, the component can be manufactured using, for example, Virtual Pattern Casting (VPC) or Direct Metal Laser Sintering (DMLS), both being processes used in rapid prototyping procedures.

In the case of VPC, an energy beam, such as a laser, cures a polymer impregnated ceramic powder in a series of layers to produce an intricately-shaped core. The core is fired and built into a wax pattern die, which is then used to produce wax patterns for use in an investment casting procedure. Single crystal, directionally solidified and equiaxed metal components, such as high pressure turbine blades and NGVs, can be cast in this way.

In the case of DMLS, the energy beam is used to produce the metal component directly by sintering or melting layers of metal particles together to form the component. At present, only equiaxed components can be produced using this technology.

Figure 1:
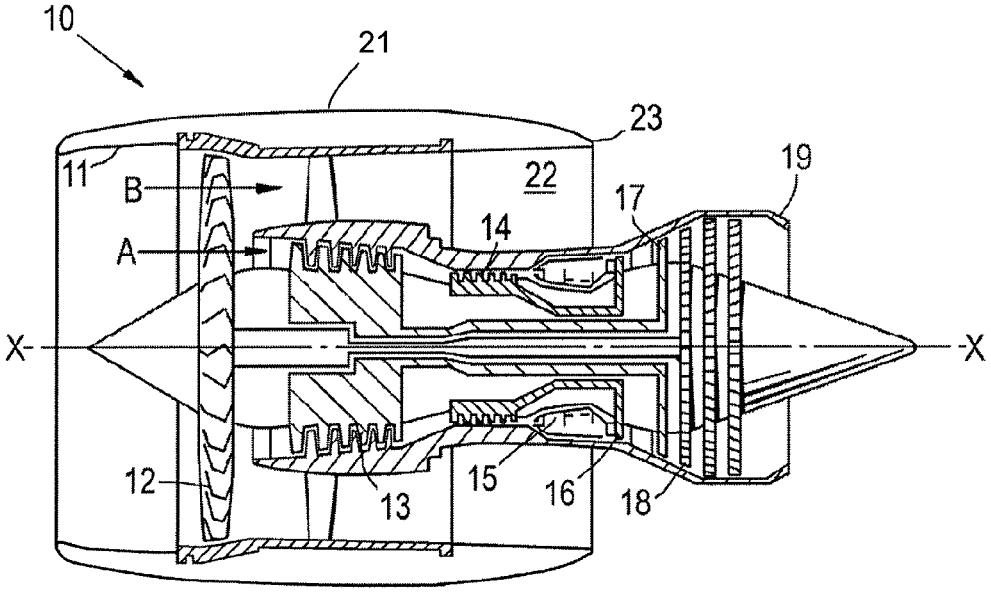
FIG. 1 shows schematically a longitudinal cross-section through a ducted fan gas turbine engine.
Figure 2:
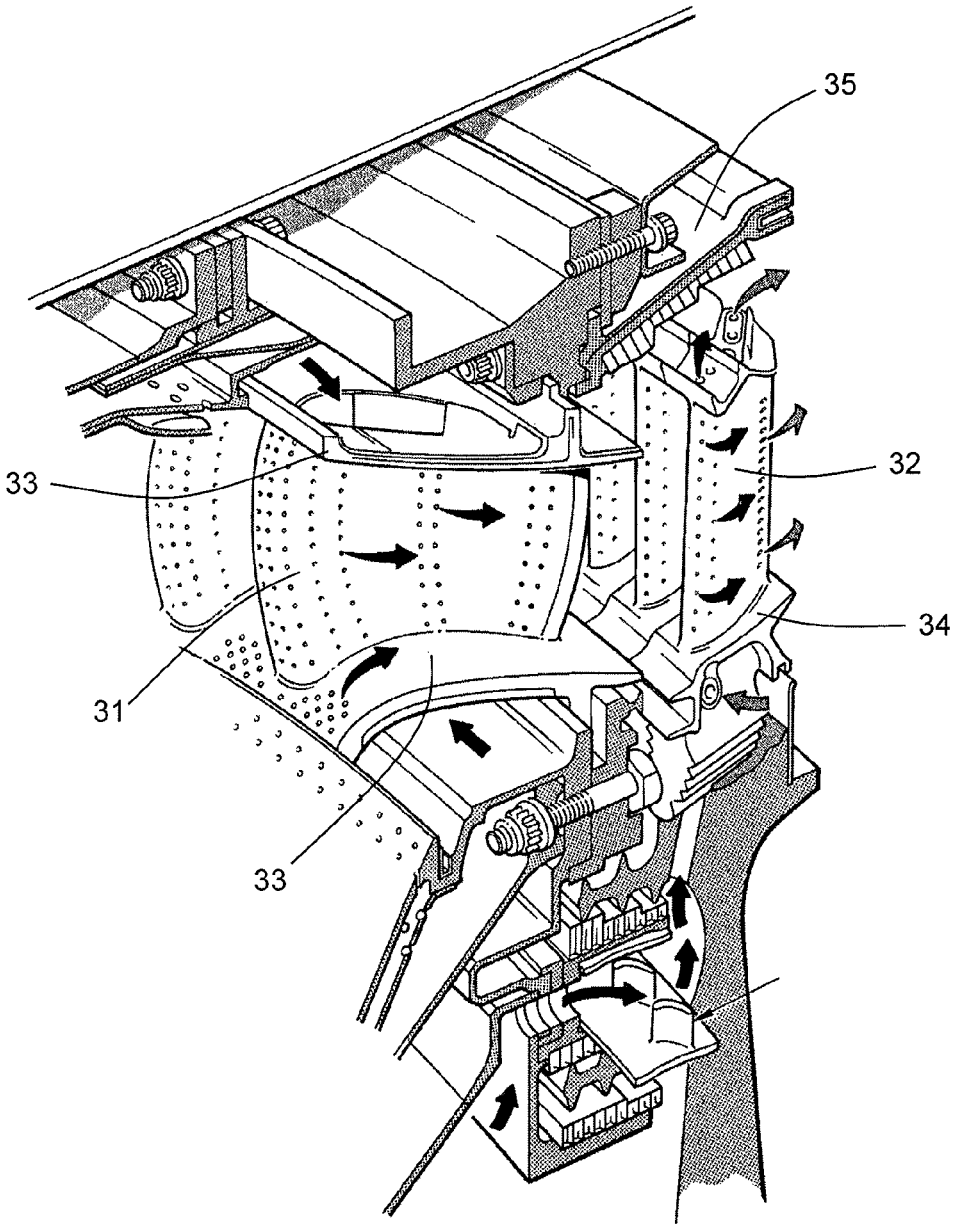
FIG. 2 shows an isometric view of a typical single stage cooled turbine.
Figure 3:
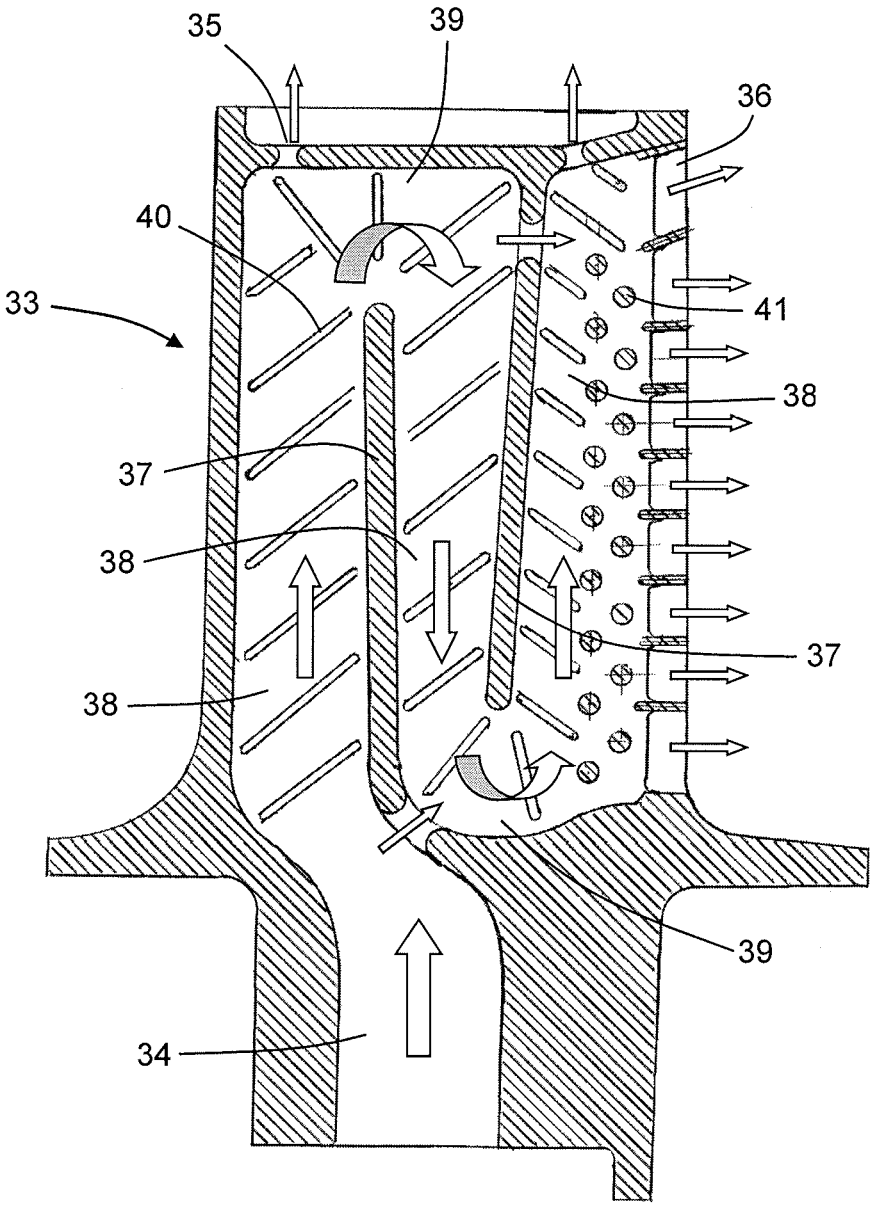
FIG. 3 shows a longitudinal cross-section through a high-pressure turbine blade.
Figure 4:
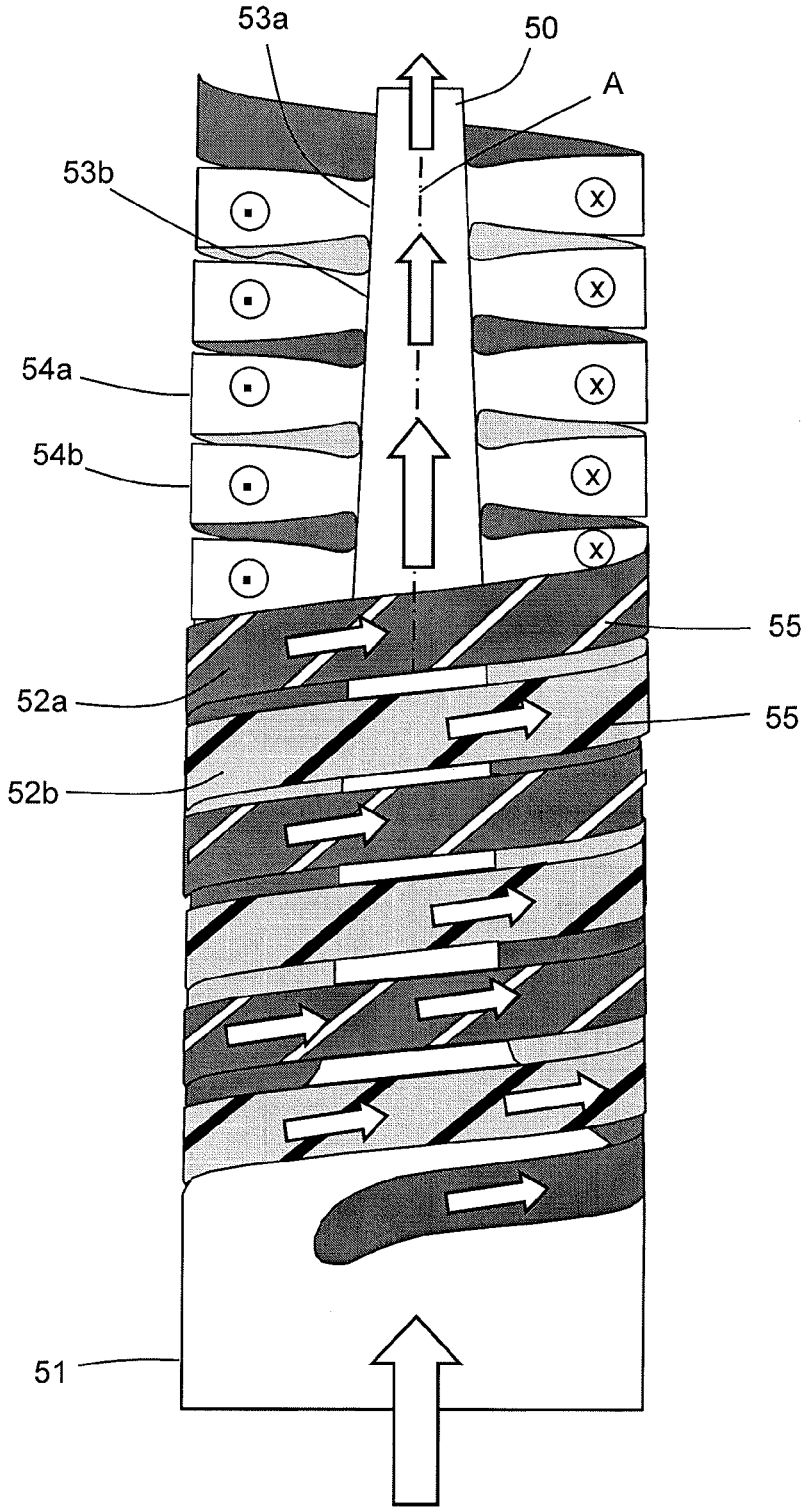
FIG. 4 shows a partially sectioned schematic view of a chamber for a flow of coolant inside a turbine blade.

FIG. 4 shows a partially sectioned schematic view of a chamber for a flow of coolant inside a turbine blade. The general direction of coolant flow is indicated by block arrows, except for sectioned portions where flow into the page is indicated by ⊗ and flow out of the page is indicated by ⊙. The chamber includes a central core passage 50 which extends along an axis A aligned with the longitudinal direction of the aerofoil portion of the blade. The coolant enters the base of the blade from the bucket groove of the turbine disc blade, flows radially outwardly through the fir-tree and shank locations 51 of the blade and to enter the core passage at one end thereof. It then continues to flow radially outwardly (i.e. along the longitudinal direction of the aerofoil portion) along the core passage through the aerofoil portion to the tip of the blade.

A pair of helical passages 52*a*, 52*b* spiral around the core passage 50 and are open thereto at their inner sides 53*a*, 53*b*. The core passage tapers in the direction of coolant flow such that the coolant is progressively fed from the core passage into the helical passages. The helical passages are only interconnected with each other via the core passage. Although not shown in FIG. 4, preferably the core passage tapers such that little or no coolant flow exits from its blade tip end, i.e. preferably substantially all the coolant flow carried by the core passage exits the core passage via the helical passages.

Figure 5:
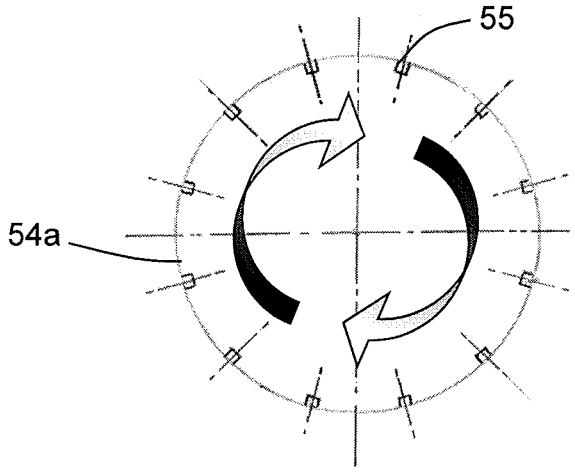
FIG. 5 shows schematically respective cross-section views through coolant flow chambers having heat transfer augmentation features in the forms of (a) angled trip strips and (b) angled steps.
Figure 5:
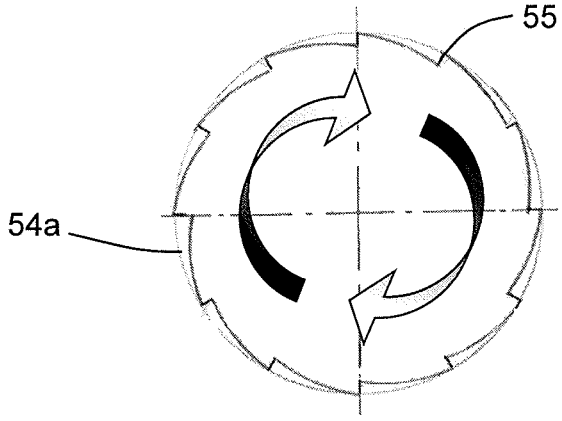

On entering the helical passages 52*a*, 52*b*, the coolant is directed towards the outer sides thereof. The progressive reduction in the flow area of the core passage 50 progressively forces the majority of the coolant flow into the helical passages. The outer walls 54*a*, 54*b* of the helical passages are interrupted by angled heat transfer augmentation features 55 such as trip strips or steps that cause the coolant flow to separate and re-attach to the outer walls, as shown schematically in FIGS. 5(*a*) and (*b*). The angled trip strips cause a secondary flow to migrate across the outer walls in the direction of the trip strips and this flow migration increases the turbulent mixing of the coolant to promote higher levels of heat transfer.

A similar cooling scheme can also be adopted inside an NGV.

In the case of a high temperature aerofoil component, flow is also bled off the helical passages 52*a*, 52*b* through rows of effusion holes which extend from the helical passages to outer surfaces of the component. The bled coolant can then form a cooling film on the gas-washed surface of the aerofoil portion. The heated coolant that is lost through the effusion holes is replaced by cooler air taken from the core passage 50.

The thickness of the helical passages 52*a*, 52*b* in the direction of the axis A increases from the core passage 50 to the outer walls 54*a*, 54*b*. These walls lie on a cylindrical surface which is substantially coaxial with the axis, and cover at about 85% of the cylindrical surface.

The helical passages 52*a*, 52*b* can have either a clockwise or anti-clockwise spiral direction.

Other cooling schemes may have just one helical passage for each chamber, and yet others may have three four or even more helical passages for each chamber.

The length of each helical passage 52*a*, 52*b* is a function of the pitch of the helix, and the pitch is in turn a function of the number of helical passage. These variables can be optimised to give the best configuration for a given heat load. For example, an aim can be to keep the velocity of the flow at the outer walls 54*a*, 54*b* at a high value, without picking up so much heat that the heat transfer rate is unduly limited further downstream.

Figure 6:
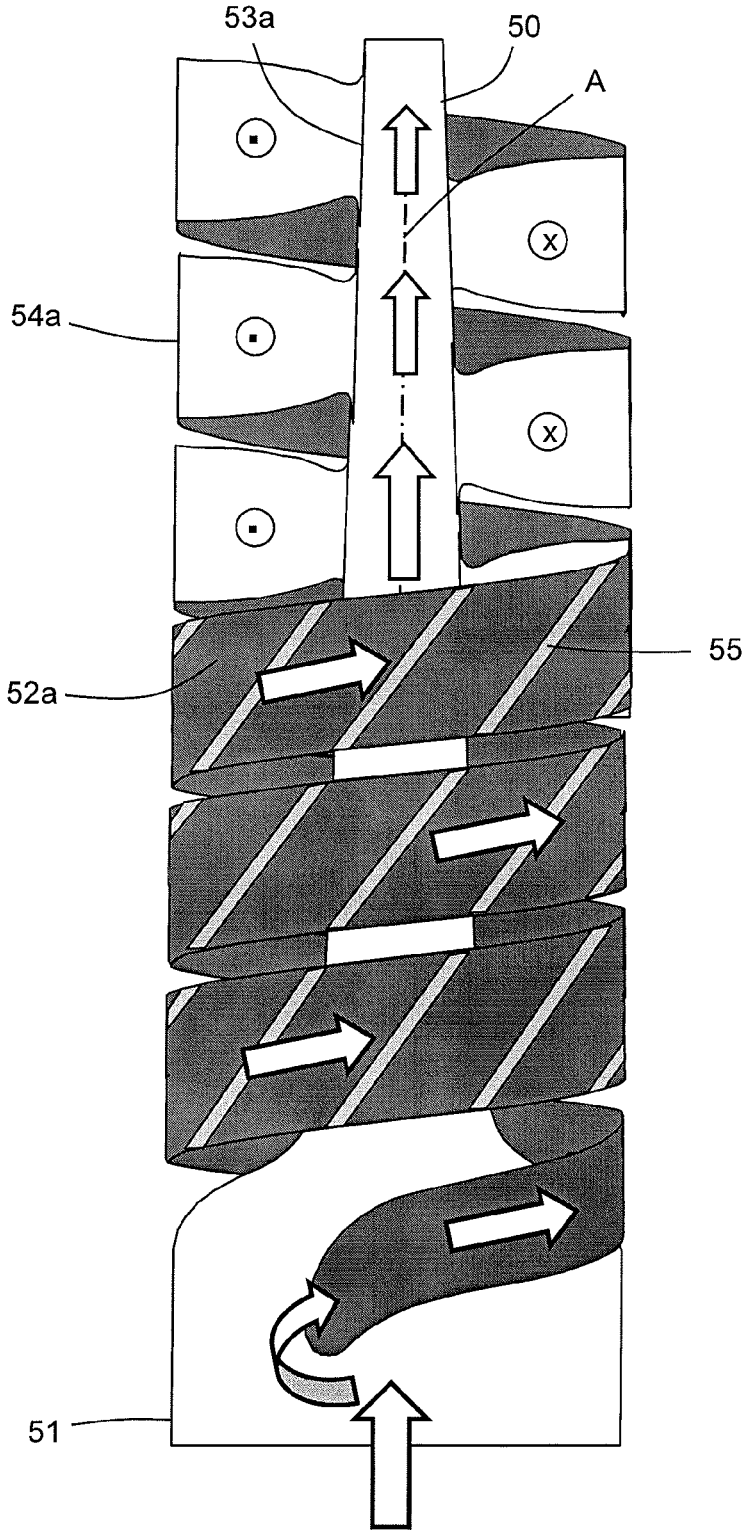
FIG. 6 shows a partially sectioned schematic view of a chamber which is similar to the chamber of FIG. 4, but has only one helical passage.

FIG. 6 shows a partially sectioned schematic view of a chamber which is similar to the chamber of FIG. 4, but in this case has only one helical passage 52*a*. In this configuration the helical passage is longer and the flow therefore picks up more heat as it travels towards the tip of the blade. This has an effect of increasing convective efficiency but reduces the convective cooling effectiveness from the root to the tip. The configuration may thus be more acceptable for use in shroudless blade designs where the stress distribution is lower towards the tip of the aerofoil.

Figure 7:
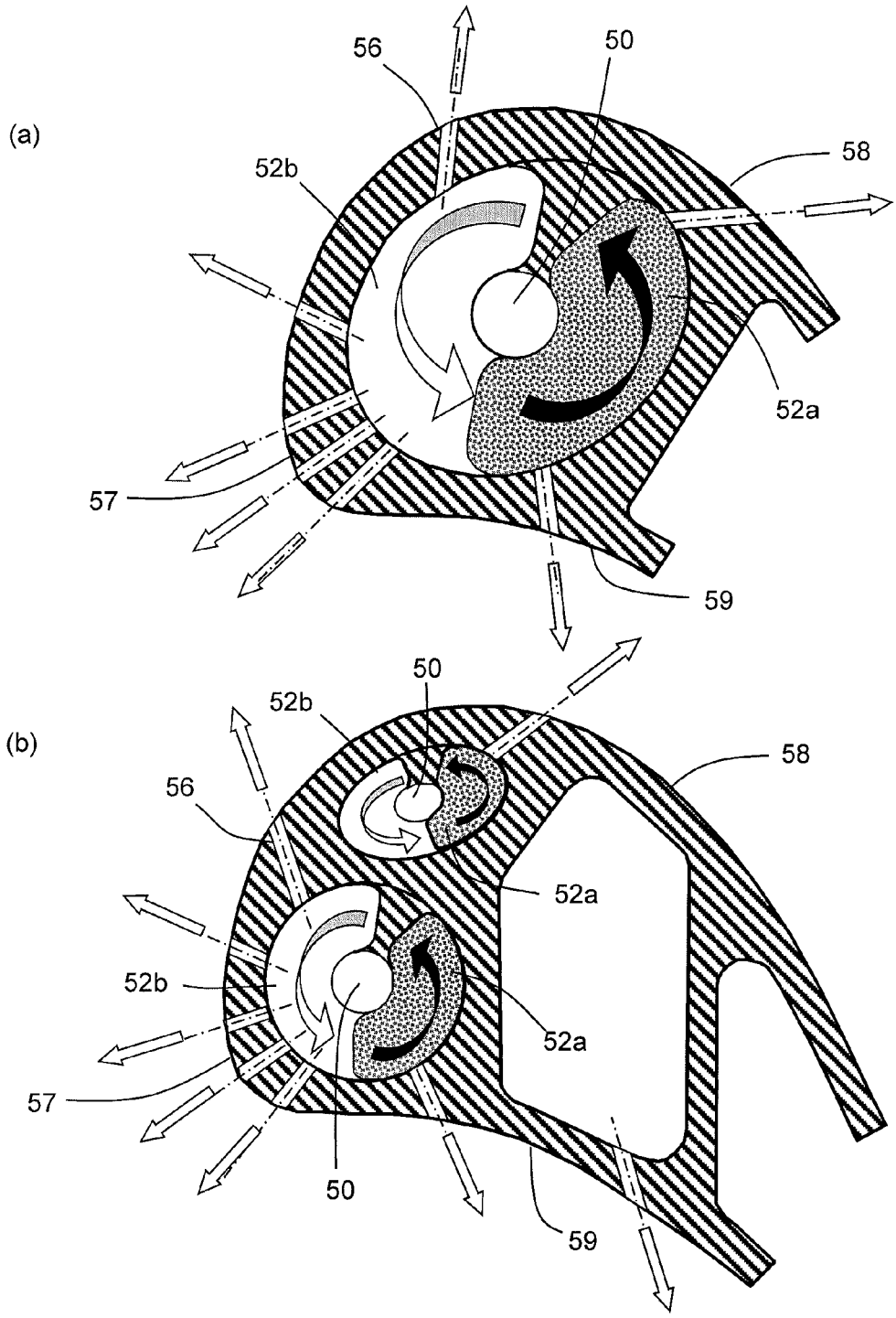
FIG. 7 shows schematically respective sectional plan views through the leading edge parts of aerofoil portions of blades or NGVs having (a) one chamber and (b) two chambers of the type shown in FIG. 4 located at or adjacent the leading edge.

FIG. 7(*a*) shows a sectional plan view through the leading edge part of an aerofoil portion of a blade or NGV having a chamber of the type shown in FIG. 4 located at the leading edge. Effusion holes 56 extend from the helical passages to the leading edge 57, suction 58 and pressure 59 surfaces of the aerofoil portion. The direction of the swirling flow in both helical passages 52*a*, 52*b* is anti-clockwise, which helps to reduce the effective pressure ratio experienced by the suction surface cooling films (static pressure feed) and increase the pressure ratio experienced by the pressure surface cooling films (static pressure feed+a portion of the dynamic pressure feed). FIG. 7(*b*) shows a sectional plan view through the leading edge part of an aerofoil portion of a blade or NGV having two chambers of the type shown in FIG. 4 located towards the leading edge. For the chamber closest the leading edge, the cylindrical surface on which the outer walls 54*a*, 54*b* lie has a circular cross-section, while for the chamber further from the leading edge (and towards the suction surface) the cylindrical surface on which the outer walls lie has an elliptical cross-section. The two chambers can have linking passages between their respective helical passages to help ensure the swirl velocities are maintained at desired levels.

Figure 8:
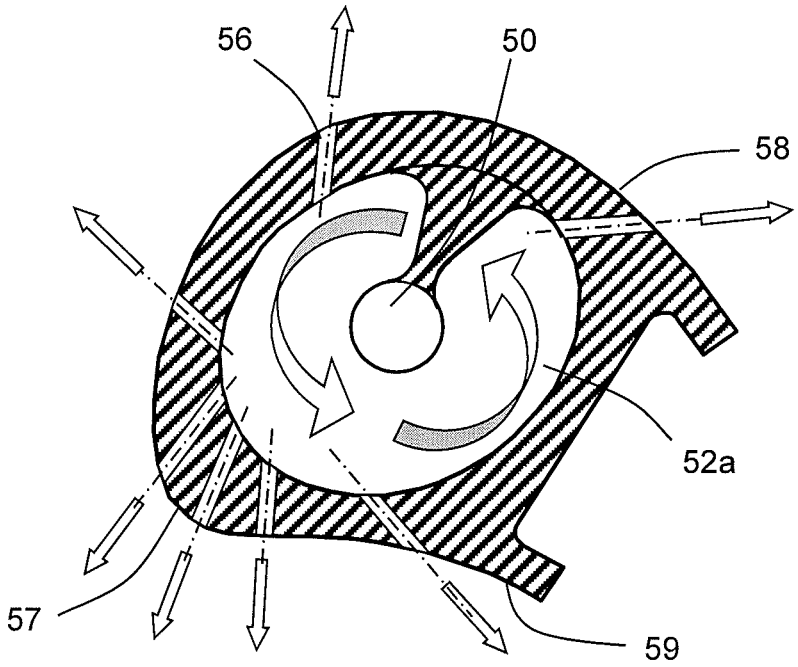
FIG. 8 shows schematically a sectional plan view through the leading edge part of an aerofoil portion of a blade or NGV having a chamber of the type shown in FIG. 6 located at the leading edge.

FIG. 8 the leading edge part of an aerofoil portion of a blade or NGV having a chamber of the type shown in FIG. 6 located at the leading edge. The angles of the effusion holes 56 are changed relative to the corresponding angles shown in FIG. 7(*a*) in order to improve the pressure ratio at the holes to ensure hot gas ingestion does not occur.

Figure 9:
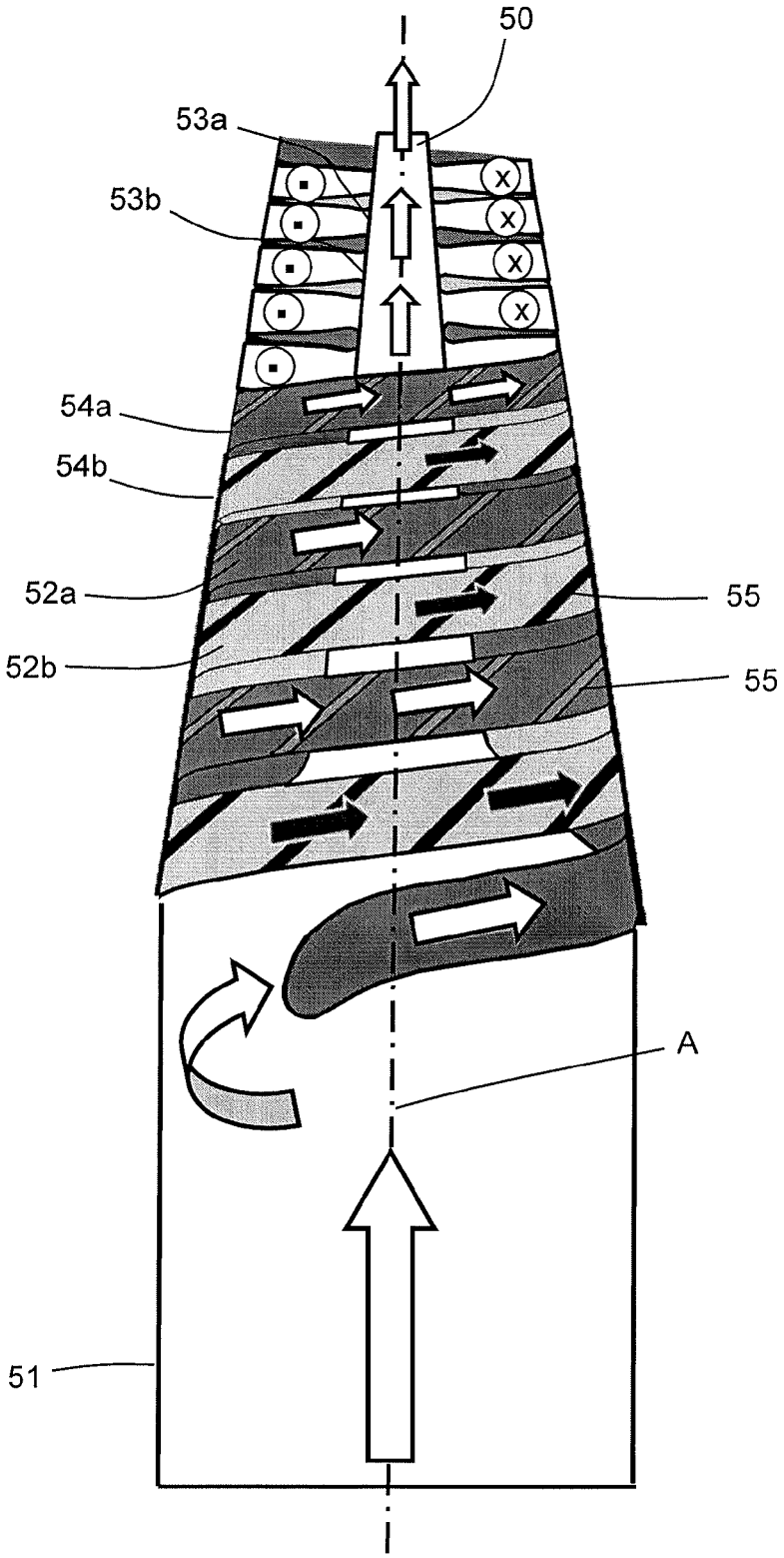
FIG. 9 shows a partially sectioned schematic view of a chamber which is similar to the chamber of FIG. 4, but tapers towards the tip of the blade.

FIG. 9 shows a partially sectioned schematic view of a chamber which is similar to the chamber of FIG. 4, but in this case the outer walls 54*a*, 54*b* lie on a frustoconical surface which is substantially coaxial with the axis A. The entire chamber thus tapers towards the tip of the blade in order to compensate for the loss of coolant bled from the effusion holes. In this way, the flow velocity at the outer walls can be kept at an elevated level by reducing the flow areas of the helical passages 52*a*, 52.

Figure 10:
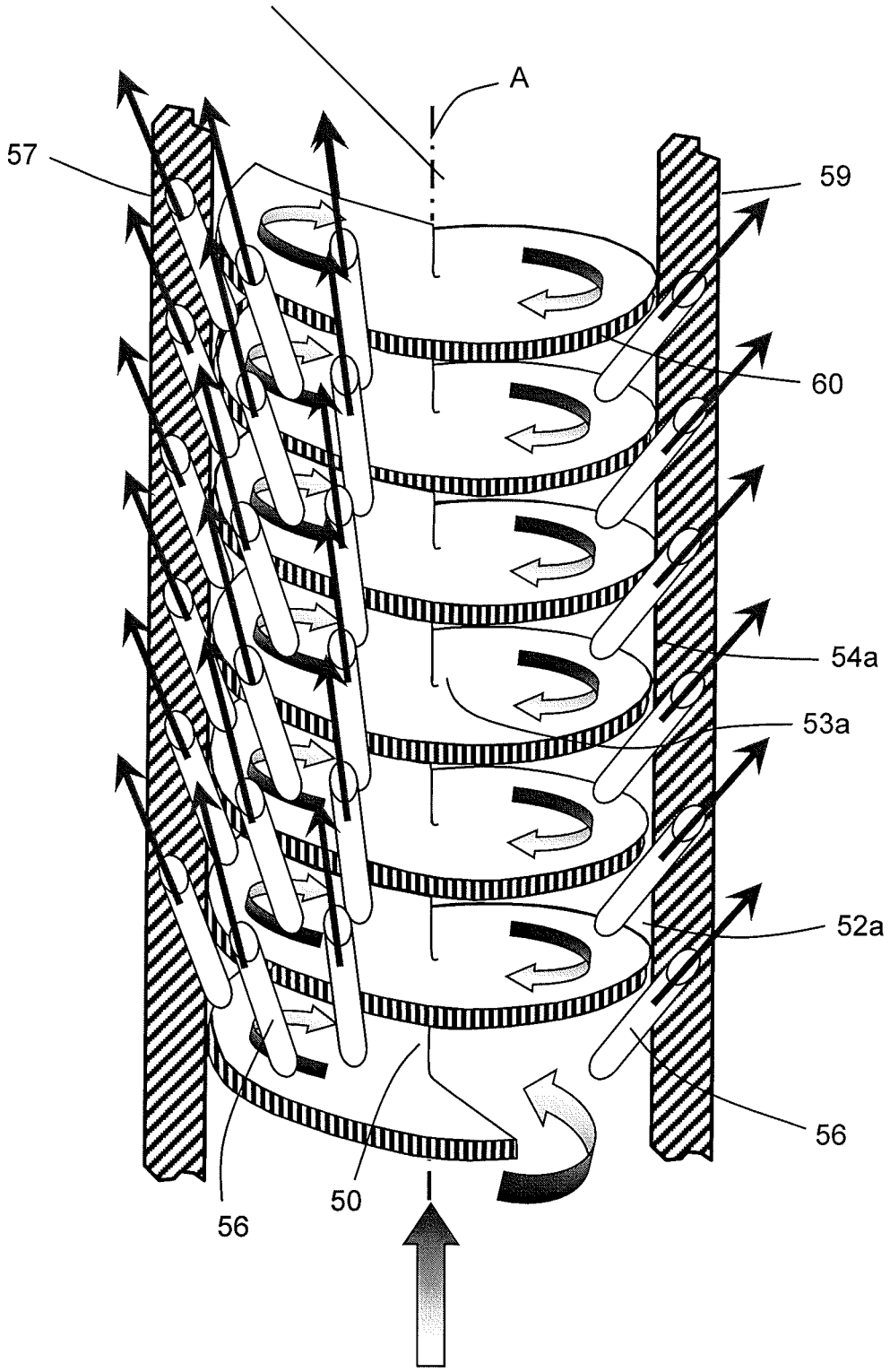
FIG. 10 shows a schematic view of a chamber which is similar to the chamber of FIG. 6, but has a helical passage of constant thickness.

The chamber can be adapted in various ways. FIG. 10 shows a schematic view of a chamber which has only one helical passage 52*a* (like the chamber of FIG. 6). However, in this case, the helical passage is of approximately constant thickness from its inner side 53*a* at the core passage 50 to its outer wall 54*a*. An internal wall 60 shaped like a twisted ribbon defines the shape of the helical passage. Significantly, there is no core passage. Thus, the coolant flow only enters the helical passage at one end of the chamber. Effusion holes 56 are shown in FIG. 10 extending from the helical passage to the pressure 59 and leading edge 57 surfaces of the aerofoil portion. Heat transfer augmentation features (not shown) can be provided on the outer wall 54*a*.

Figure 11:
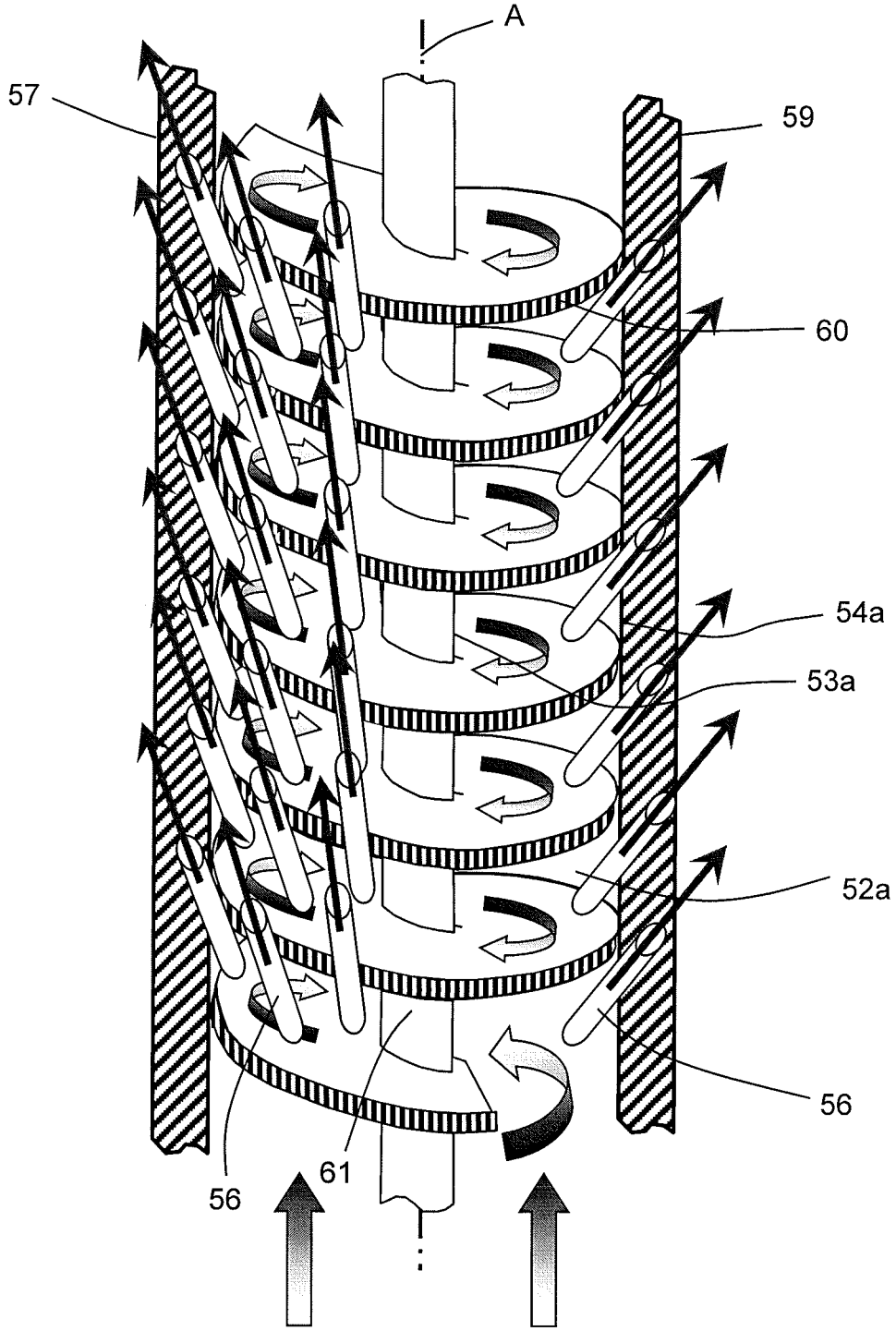
FIG. 11 shows a schematic view of a chamber which is similar to that of FIG. 10, but has a support pillar is located at its axis.

FIG. 11 shows a schematic view of a chamber which is similar to that of FIG. 10, but in this case a pillar 61 is located on the axis A to provide support for the internal wall 60. A further option is for the pillar to be hollow such that coolant can be supplied directly to the tip of the blade through the pillar to cool the tip geometry.

Figure 12:
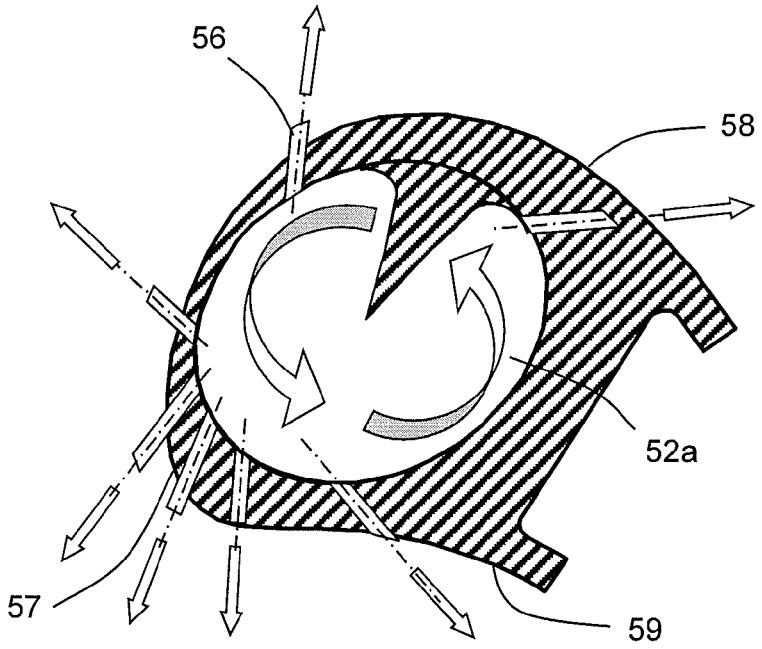
FIG. 12 shows schematically respective sectional plan views through the leading edge part of an aerofoil portion of a blade or NGV having (a) a chamber of the type shown in FIG. 10 located at the leading edge, and (b) a chamber of the type shown in FIG. 11 located at the leading edge.
Figure 12:
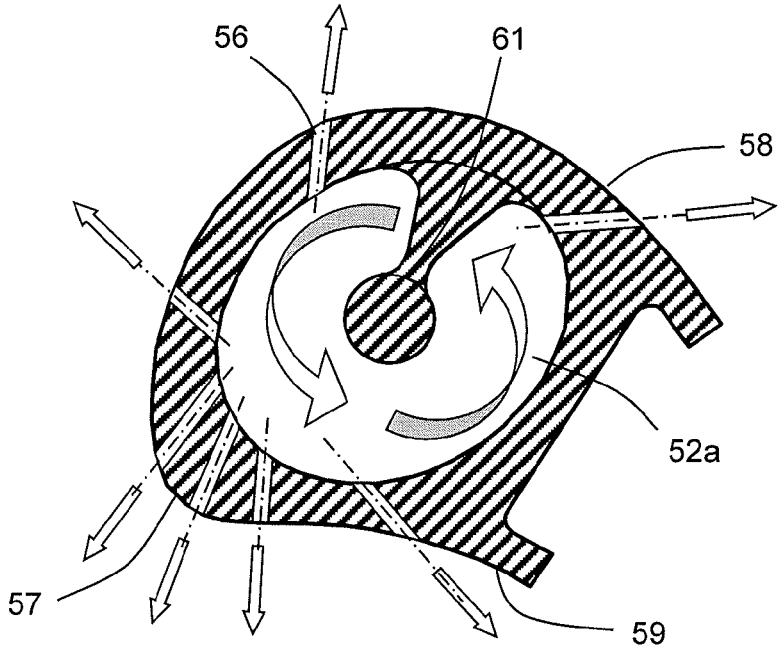

FIG. 12 shows respective sectional plan views through the leading edge part of an aerofoil portion of a blade or NGV having (a) a chamber of the type shown in FIG. 10 located at the leading edge, and (b) a chamber of the type shown in FIG. 11 located at the leading edge.

Figure 13:
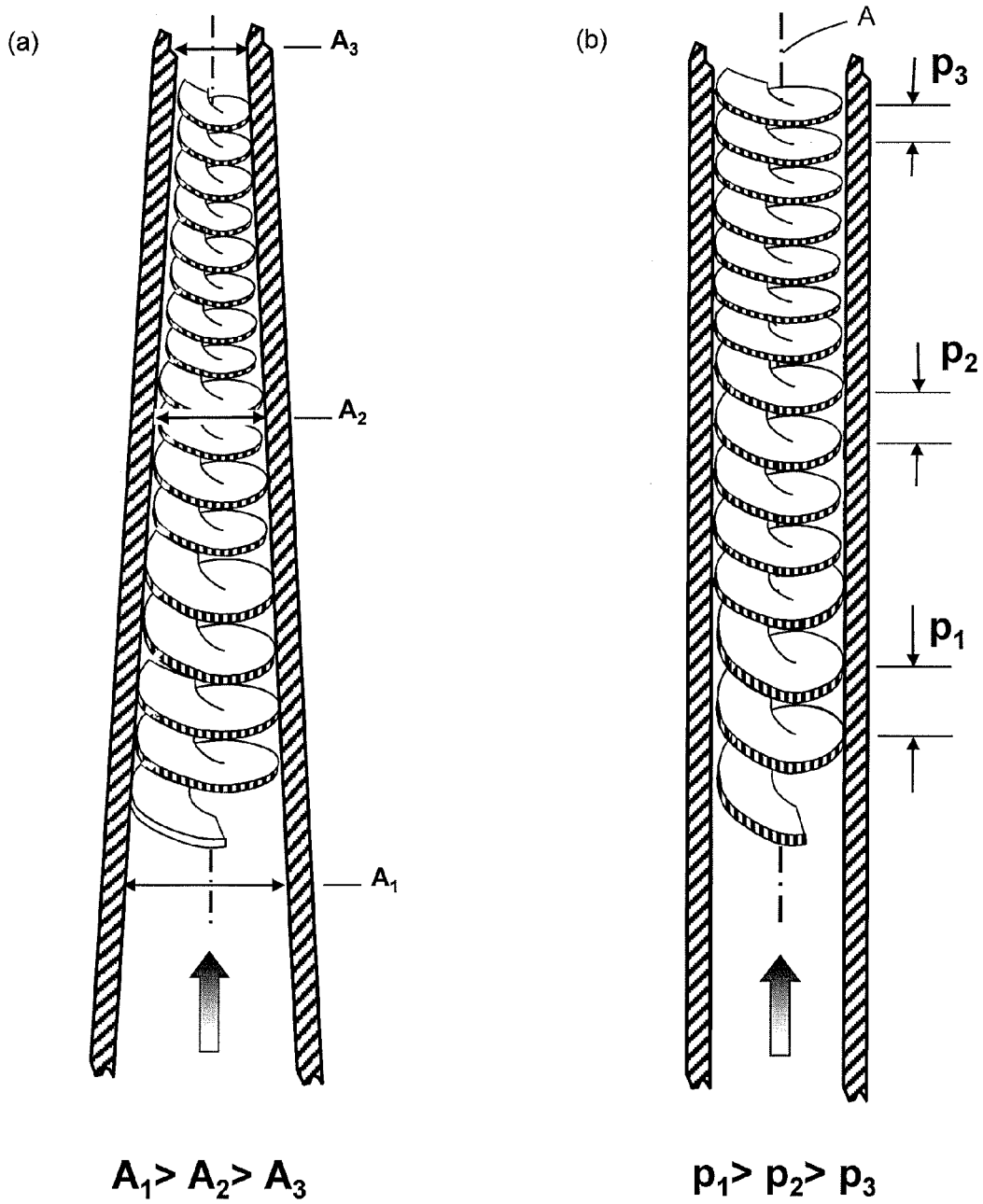
FIG. 13 shows schematically chambers which are similar to the chamber of FIG. 10, but (a) with a taper towards the end of the passage, and (b) with the pitch of the helical passage reducing from the beginning to the end of the passage.

As discussed above in relation to FIG. 9, the entire chamber can taper towards the end of the passage, and such a tapering adaptation can be made to the chambers of FIGS. 10 and 11, as shown in FIG. 13(*a*). Another option which can be applied to all the above-mentioned chambers is to vary the pitch p of the helical passage or passages along the length of the axis A, as shown schematically in FIG. 13(*b*). Such pitch variation can help to ensure that local flow velocities, Reynold's numbers and heat transfer coefficients are maintained at acceptable levels throughout the chamber.

CFD analyses of chambers such as those shown in FIGS. 4 to 13 have shown that the local Mach number of the coolant flow remains at a relatively low level in the vicinity of the fir-tree attachment and the shank cavity 51 and then becomes high in the chamber in the aerofoil portion. However, the Mach number level falls steadily with distance up the aerofoil portion towards the blade tip as the film cooling air flow is bled from the chamber. High velocity tangential flow at the outer walls 54*a*, 54*b* of the helical passages 52*a*, 52*b* is observed, and also high momentum radial flow in the core passage 50 (where present). The flow area of the core passage is an important parameter which impacts the velocity levels in the helical passages.

The cooling arrangement can incorporate various modifications, some of which are discussed above. For example:

- The thickness, diameter and pitch of the helical passage(s) can be varied with distance along the axis.
- The diameter of the core passage or support pillar can be varied with distance along the axis.
- Different heat transfer augmentation devices can be included, such as trip strips, pin fins, fins, stepped surfaces, surface roughness, rifling, flow deflectors etc.
- A lead-in spiral passage can be included, e.g. in the shank cavity 51, before the chamber to pre-swirl the flow.
- The flow in the helical passage(s) can be supplemented with additional coolant bled in from an adjacent cooling passage.
- The flow in the helical passage(s) adjacent to internal divider walls of the component can be forced to separate from such walls and prevented from re-attaching by providing oversize trip strips or closely pitched trip strips. This would reduce the coolant temperature pickup from the divider walls.
- The effusion holes can be substituted by slots which are e.g. cast into the component.
- A deflector formation can be provided at the entrance to the chamber to prevent or reduce entry of dirt particles into the helical passage(s) and subsequently blocking the effusion holes. The deflected dirt can be channelled, for example, through the core passage and into the annulus gas-path through dust holes machined into the tip of the component.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. An aerofoil component of a gas turbine engine, the component having a longitudinally extending aerofoil portion which spans, in use, a working gas annulus of the engine, the aerofoil portion containing an internal chamber for a flow of coolant, the internal chamber including a helical passage which spirals in a plurality of turns around a support pillar which is hollow and defines a core passage that extends along an axis that extends in a length direction of the aerofoil portion and the support pillar supports walls which define the helical passage such that coolant flows around the support pillar and along the helical passage and the support pillar tapers in a direction of coolant flow.

2. An aerofoil component according to claim 1, wherein the thickness of the helical passage in the direction of said axis is greater at the side of the helical passage most distal from the axis than at the side of the helical passage most proximal to the axis.

3. An aerofoil component according to claim 1, wherein the helical passage is configured to extend, in use, over at least half of the span of the working gas annulus.

4. An aerofoil component according to claim 1, wherein a plurality of effusion holes extend from the helical passage to the outer surface of the component.

5. An aerofoil component according to claim 1, wherein the helical passage includes heat transfer augmentation features which cause the coolant flow to separate from and reattach to the walls thereof.

6. An aerofoil component according to claim 1, wherein the chamber includes one or more further helical passages which each spiral in a plurality of turns around said axis.

7. An aerofoil component according to claim 1, wherein the or each helical passage has an outer wall at the side of the helical passage most distal from the axis, the wall or walls lying on a cylindrical or frustoconical surface which is substantially coaxial with said axis, wherein the outer wall bounds the internal chamber.

8. An aerofoil component according to claim 7, wherein the wall or walls cover at least 50% of the cylindrical or frustoconical surface.

9. An aerofoil component according to claim 1, wherein the chamber extends from a root of the component and has an inlet for the flow of coolant at the root.

10. An aerofoil component according to claim 1, wherein the chamber is located at or adjacent a leading edge of the component.

11. An aerofoil component according to claim 1, wherein the aerofoil portion contains a plurality of the internal chambers.

12. A gas turbine engine having one or more aerofoil components according to claim 1.

* * * * *